US011207880B2

(12) United States Patent
Kersten et al.

(10) Patent No.: US 11,207,880 B2
(45) Date of Patent: Dec. 28, 2021

(54) DEVICE, METHOD AND PRINTING PRESS FOR MULTIPLE PRINTING OF PRINTING SUBSTRATE SHEETS

(71) Applicant: KOENIG & BAUER AG, Würzburg (DE)

(72) Inventors: Thomas Kersten, Chernex (CH); Patrick Kress, Bad Mergentheim-Edelfingen (DE); Martin Lanig, Reichenberg GT Fuchsstadt (DE); Volkmar Schwitzky, Würzburg (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/277,047

(22) PCT Filed: May 9, 2019

(86) PCT No.: PCT/EP2019/061956
§ 371 (c)(1),
(2) Date: Mar. 17, 2021

(87) PCT Pub. No.: WO2020/074135
PCT Pub. Date: Apr. 16, 2020

(65) Prior Publication Data

US 2021/0316546 A1 Oct. 14, 2021

(30) Foreign Application Priority Data

Oct. 10, 2018 (DE) ..... 10 2018 125 033.9

(51) Int. Cl.
*B41F 7/06* (2006.01)
*B41F 25/00* (2006.01)
*B41F 21/00* (2006.01)

(52) U.S. Cl.
CPC ..... *B41F 21/005* (2013.01)

(58) Field of Classification Search
CPC .... B41F 11/02; B41F 13/0024; B41F 21/005; B41F 7/06; B41F 7/12; B41F 25/00
(Continued)

(56) References Cited

U.S. PATENT DOCUMENTS 3,174,748 A 3/1965 Roberts et al.
3,341,195 A 9/1967 Herman et al.
(Continued)

FOREIGN PATENT DOCUMENTS

DE 19920371 A1 12/1999
DE 10033838 A1 * 1/2002 ..... B41F 21/005
(Continued)

OTHER PUBLICATIONS

International Search Report of PCT/EP2019/061956 dated Jul. 17, 2019.

*Primary Examiner* — Leslie J Evanisko
(74) *Attorney, Agent, or Firm* — Mattingly & Malur, PC

(57) ABSTRACT

The invention relates to a device for printing sheets of printing substrate (02), having a first printing nip (12) which is formed between a first cylinder (19; 19*) that acts as a transport cylinder (19; 19*) and a second cylinder (18), and in which the printing substrate sheets (02) can be printed on one or on both sides with one or more collected print image segments, and having a second printing nip (11) lying downstream in the printing substrate path, which printing nip is disposed at a level lying below the first printing nip (12) and is formed between a third cylinder (17) that acts as a transport cylinder (17) and a fourth cylinder (16), and in which the printing substrate sheets (02) can be printed on one or on both sides with one or more collected print image segments, wherein the printing substrate sheets (02) can be
(Continued)

conveyed via at least one rotating transport means (33; 38; 39) along a transport path from the cylinder (19; 19*) that acts as a transport cylinder (19; 19*) of the first printing nip (12) to the cylinder (17) that acts as a transport cylinder (17) of the second printing nip (11), wherein on the transport path, downstream of the cylinder (19; 19*) that acts as a transport cylinder (19; 19*) of the first printing nip (12) and upstream of the cylinder (17) that acts as a transport cylinder (17) of the second printing nip (11), at least one first electrode (37; 41) directed toward the outer circumference of the at least one rotating transport means (33) is arranged in an angular segment lying in the transport path for the printing substrate sheets (02) in such a way that when an electric voltage is applied, a printing substrate sheet (02) being guided past the electrode (37; 41) can be electrostatically charged.

15 Claims, 7 Drawing Sheets

(58) Field of Classification Search
USPC ..... 101/409, 229, 230
See application file for complete search history.

(56) References Cited

U.S. PATENT DOCUMENTS 3,342,129 A 9/1967 William
3,346,253 A * 10/1967 Paschke ..... B41F 21/005
226/94

FOREIGN PATENT DOCUMENTS

| | | | |
|---|---|---|---|
| DE | 10033839 | A1 | 1/2002 |
| DE | 102010028702 | B4 | 9/2013 |
| EP | 2982510 | A1 | 2/2016 |
| EP | 3017946 | A1 | 5/2016 |
| EP | 2574463 | B1 | 4/2018 |
| WO | 2016/071870 | A1 | 5/2016 |

* cited by examiner

DEVICE, METHOD AND PRINTING PRESS FOR MULTIPLE PRINTING OF PRINTING SUBSTRATE SHEETS

CROSS-REFERENCE TO RELATED APPLICATION

This application is the U.S. National Stage, under 35 USC § 371, of PCT/EP2019/061956, filed May 9, 2019; published as WO 2020/074135 A1 on Apr. 16, 2020, and claiming priority to DE 10 2018 125 033.9, filed Oct. 10, 2018, the disclosures of which are expressly incorporated herein in their entireties by reference.

FIELD OF THE INVENTION

The present invention relates to a device, a method, and a security printing press for the multiple printing of sheets of printing substrate, in particular sheets of security documents. The device for printing sheets of printing substrate has a first printing nip which is formed between a first cylinder, that acts as a first transport cylinder, and a second cylinder. The printing substrate sheets can be printed on one or on both sides with one or more collected print image segments. A second printing nip lies downstream, in the printing substrate path, which second printing nip is disposed at a level lying below the first printing nip, and is formed between a third cylinder, that acts as a second transport cylinder, and a fourth cylinder. The printing substrate sheets can be printed on one or on both sides with one or more collected print image segments. The printing substrate sheets can be conveyed, via at least one rotating transport means, along a transport path from the cylinder that acts as the first transport cylinder of the first printing nip to the cylinder that acts as the second transport cylinder of the second printing nip. The printing substrate sheets are printed on one or on both sides with the one or more collected print image segments in the first of the at least two printing nips in the transport path and are transported along the transport path running from top to bottom to the second of the at least two printing nips, where they are printed on one or on both sides with the one or more collected print image segments. The transport path of the printing substrate sheets from the first to the second printing nip is carried out by the successive transfer via one or more rotating transport means.

BACKGROUND OF THE INVENTION

From WO 2016/071870 A1 a printing press is known, by means of which sheet-format substrate guided along a transport path can be printed in a multicolor perfecting printing process in two printing nips in succession, which are spaced apart in the transport path. The multicolor printing process is carried out by a respective collect printing couple such that the print image segments from multiple forme cylinders are collected on one collect cylinder and are then transferred together to the substrate in the printing nip.

In U.S. Pat. No. 3,342,129 A, a sheet is pressed electrostatically against an impression cylinder by the application of an electric field between the needles of a high-voltage electrode and the grounded impression cylinder.

EP 2 574 463 B1 also discloses a sheet-fed printing press, in which the printing sheet is first set on the impression cylinder by a pressing roller, assisted by a jet of blower air directed into the roller nip between impression cylinder and pressing roller, and then the printing sheet is pressed onto the impression cylinder by electrostatic forces.

DE 10 2010 028 702 B4 relates to a turning device of a sheet-fed printing press, comprising a feed drum, a storage drum, and a turning drum. A blower device directed at the storage drum and an ionization device are used to improve sheet guidance by reducing the trailing angle from the regions adjoining the trailing edge.

EP 2 982 510 A1 discloses a printing press having two plateless printing units, in which multiple sheet guiding elements are directed toward the impression cylinder upstream of an inkjet printing nip in order to lay the sheet flat upstream of the inkjet printing head.

These sheet guiding elements may be embodied as blower tubes or as mechanical or electrostatic guide elements.

DE 199 20 371 A1 relates to a turning device of a sheet-fed printing press, in which it is possible to coat the circumferential surface of the impression cylinder in the region of the rear edge of the sheet with an electrically insulating material and to secure the rear edge in this region by an electrode arrangement on the outer circumference.

DE 100 33 839 A1 discloses a dryer apparatus in a sheet-fed printing press, which, in addition to a blower air nozzle and/or a radiation source, comprises a high-voltage electrode, which is intended to destroy the laminar air layer carried along on the printing substrate.

EP 3 017 946 A1 discloses a printing tower having two printing nips arranged one above the other, by which each of the sheets can be printed on both sides.

DE 10 2010 028 698 A1 relates to a turning device of a sheet-fed printing press, comprising a feed drum, a storage drum, and a turning drum, wherein to improve sheet guidance in the turning device, the storage drum has sections with different degrees of roughness, to allow electrostatic adherence to be influenced by the different roughness degrees. During the transfer of the sheets from the storage drum to the turning drum, the trailing end of a sheet should adhere less strongly to the storage drum, while the leading end adheres more strongly. In an advantageous refinement, for the electrostatic charging of the sheets an ionization device is provided on the outer circumference of the storage drum.

SUMMARY OF THE INVENTION

The object of the present invention is to create an improved device and a printing press for the multiple printing of sheets of printing substrate by the associated method.

The object is attained according to the invention in that, on the transport path, downstream of the cylinder that acts as a first transport cylinder of the first printing nip, and upstream of the cylinder that acts as a second transport cylinder of the second printing nip, at least one first electrode, which is directed towards the outer circumference of the at least one rotating transport means, is arranged in an angular segment lying in the transport path for the printing substrate sheets in such a way that, when an electric voltage is applied, a printing substrate sheet being guided past the electrode, can be electrostatically charged. A sheet feeder is located upstream of the printing nips in the printing substrate path and a pile delivery is provided downstream. The arrangement of the printing nips, in a printing nip group, may be configured, in particular, as a printing tower.

The advantages to be achieved by the invention consist, in particular, in a reduced risk of defective printed images. This advantage results from a prevention of effects caused by centrifugal forces and/or gravity during the transport of sheets in critical sections of the transport path.

To this end, in a particularly advantageous embodiment, contact between the printing substrate, in particular a freshly printed surface, and components of the printing press is prevented at critical points during transfers between printing nips that are spaced apart in the transport path and/or defective printing upon entering a printing nip is avoided. In the former, the trailing section of the sheet is prevented from "striking", for example, which is quite advantageous for an outer side of a sheet that is not freshly printed, but is especially advantageous for a freshly printed side of a sheet. The latter is advantageous particularly in cases in which the printing nip is preceded by a steeply sloping transport path section, resulting in the risk that the trailing section of a sheet may detach prematurely from the preceding transport means due to gravity. This can lead to an uncontrollable impingement on the cylinder, e.g. the ink-carrying cylinder, of the printing nip to be traversed, which can lead to smearing or duplication of the print image.

This is advantageous, in particular, for a printing unit having a transport path that leads the substrate to the printing nip from above the printing couple cylinders involved in the printing nip and/or having a transport path that leads the substrate downward away from the printing nip to a location lying below the printing couple cylinders involved in the printing nip. The apparatus according to the invention can then serve to hold back the trailing substrate end coming from further above. At the leading end, the substrate sheet executes a movement guided by holding devices.

This is also of particular advantage in the case of perfecting printing and/or for simultaneous multicolor printing because in the first case there is no unprinted and therefore less sensitive side and in the second case a particularly large amount of fresh printing ink is applied all at once in only one printing nip.

According to the invention, this is achieved by using a device for electrostatic charging, in particular an electrode. On the transport path downstream of a cylinder that acts as a transport cylinder of the first or upstream printing nip in the transport path and upstream of a cylinder that acts as a transport cylinder of the second or downstream printing nip in the transport path, an electrode directed toward the transport path is or is to be arranged in such a way that when an electric voltage is applied, a substrate sheet being guided past the voltage electrode is or can be electrostatically charged.

This is preferably accomplished without contact between electrode and substrate.

In a particularly advantageous refinement, the electrostatic application/holding process is assisted by blown air directed onto the transport path, particularly preferably simultaneously with or immediately before the application of the electric field.

Other refinements, which may be added individually or in combinations to the basic concept of the invention, may be found in the dependent claims and in the exemplary embodiments.

BRIEF DESCRIPTION OF THE DRAWINGS

Exemplary embodiments of the invention are illustrated in the set of drawings and will be described in greater detail in the following.

In the drawings.

DESCRIPTION OF PREFERRED EMBODIMENTS

Figure 1:
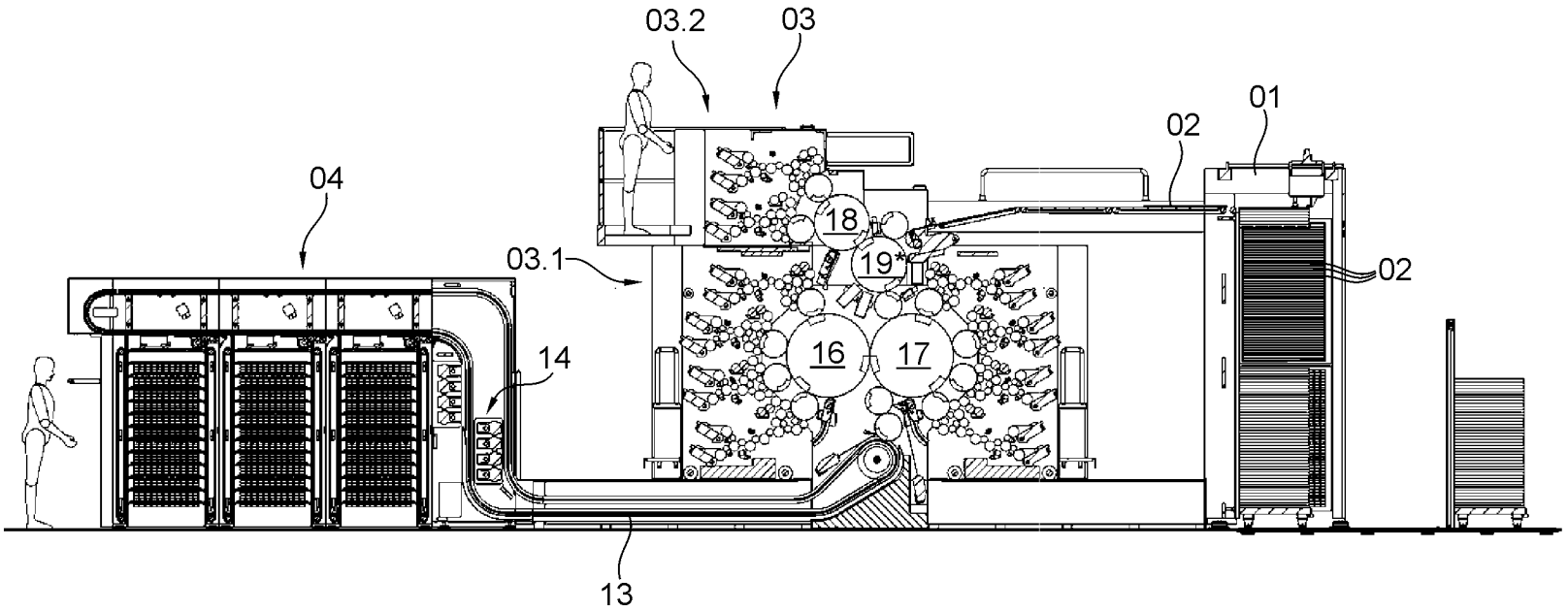
FIG. 1 depicts an exemplary embodiment of a printing press comprising a printing assembly in the first embodiment.
Figure 2:
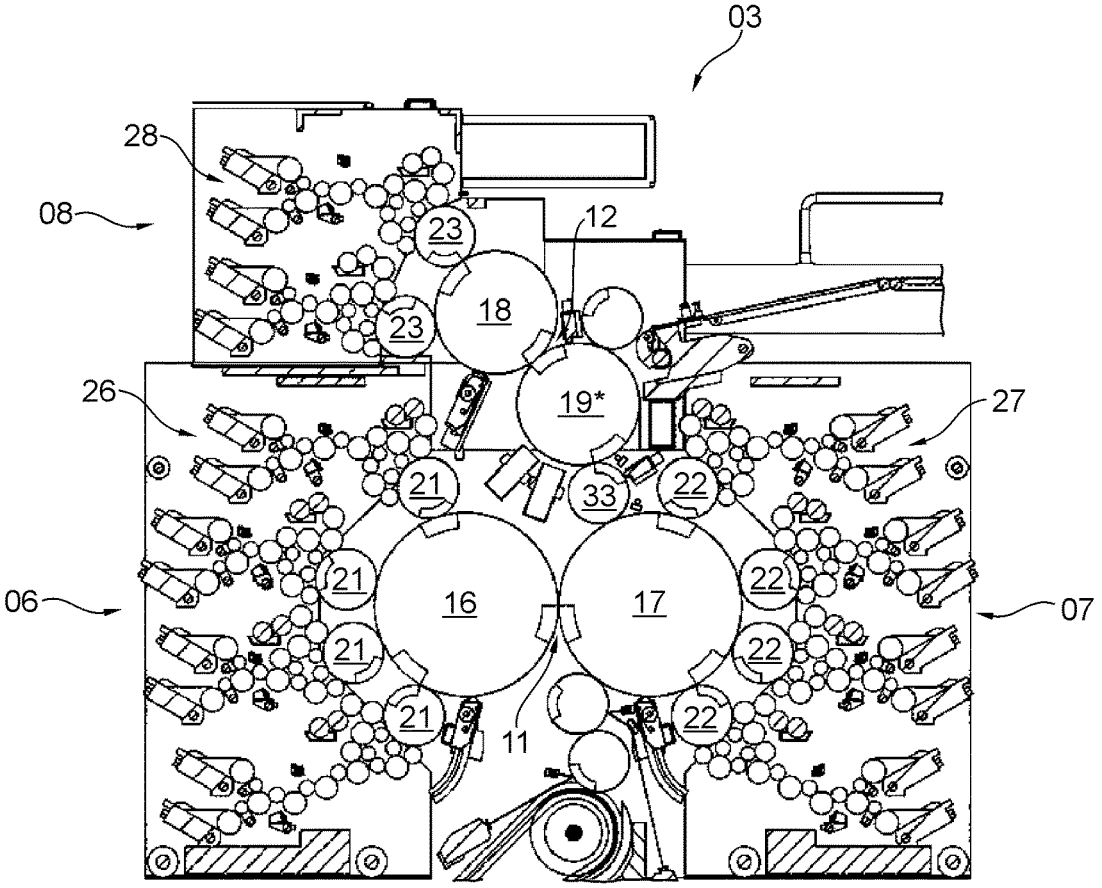
FIG. 2 is an enlarged illustration of the printing assembly in the first embodiment from FIG. 1.
Figure 4:
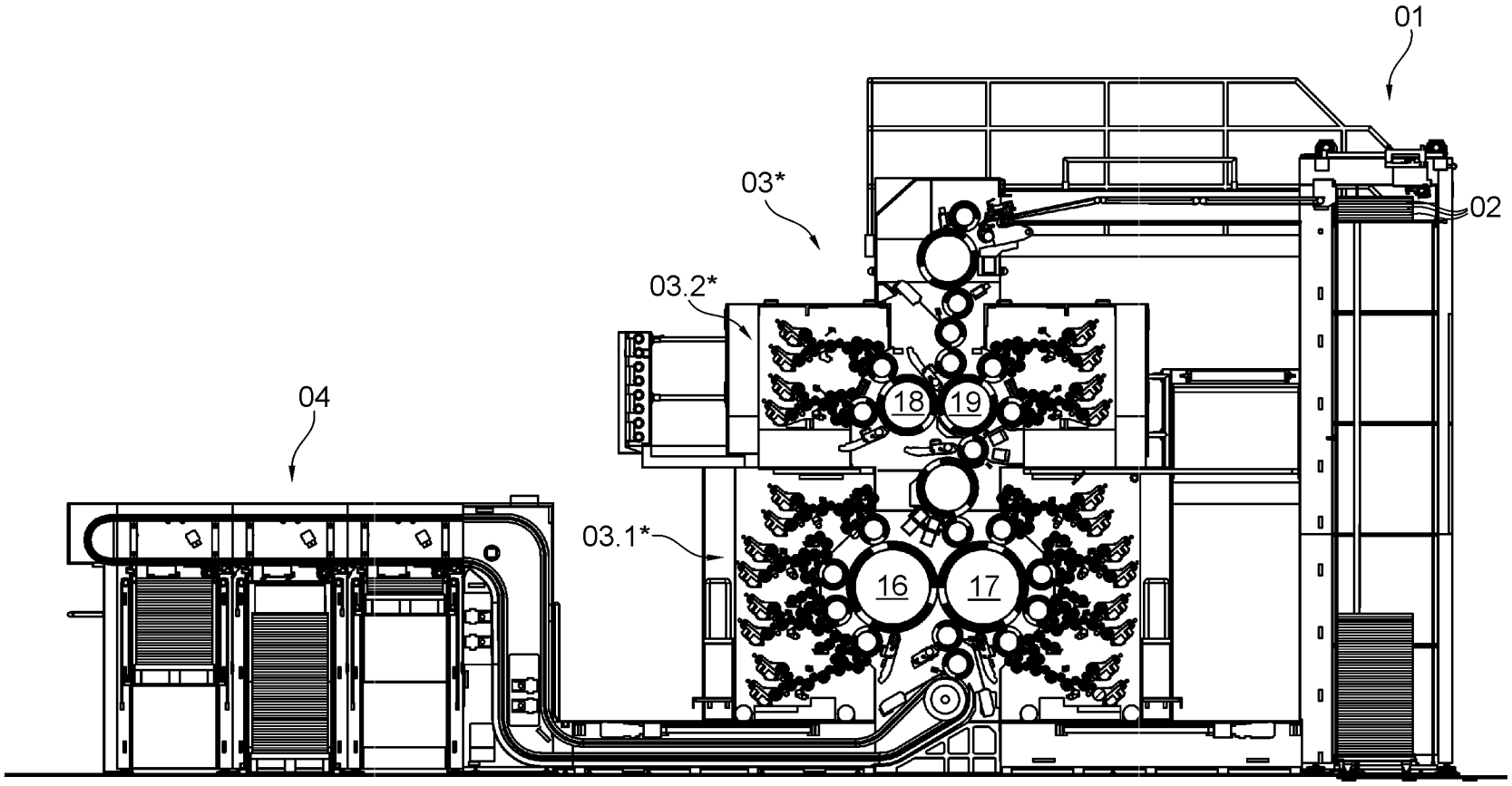
FIG. 4 depicts an exemplary embodiment of a printing press comprising a printing assembly in the second embodiment.
Figure 5:
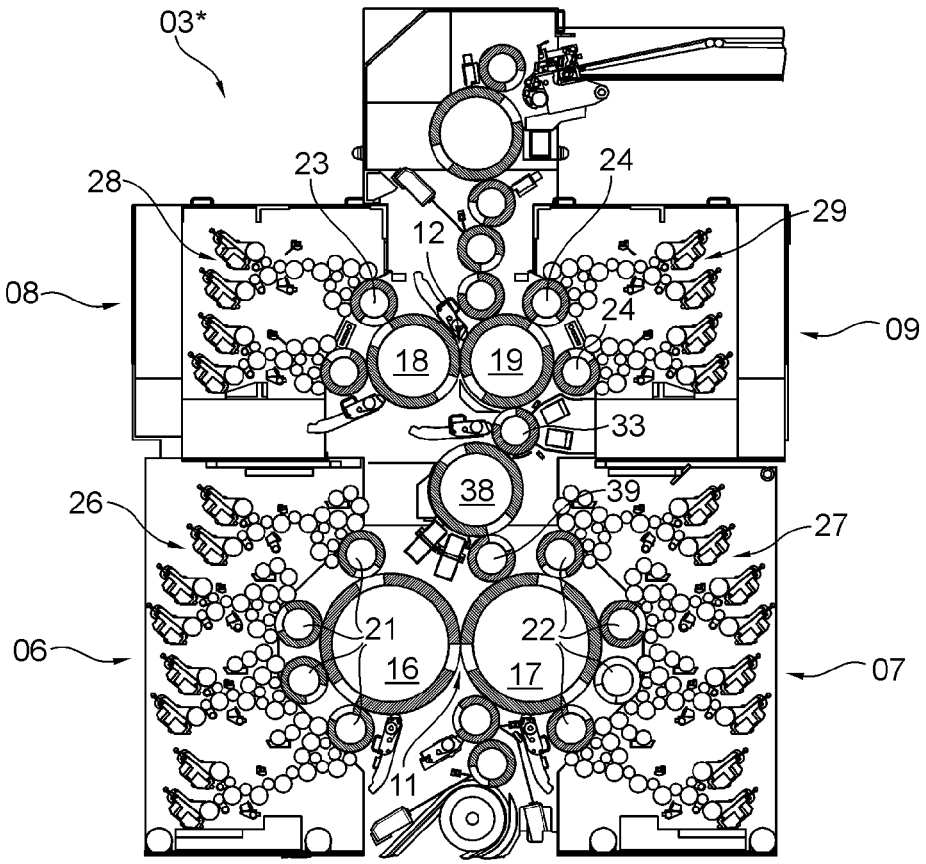
FIG. 5 is an enlarged illustration of the printing assembly in the second embodiment from FIG. 4.
Figure 6:
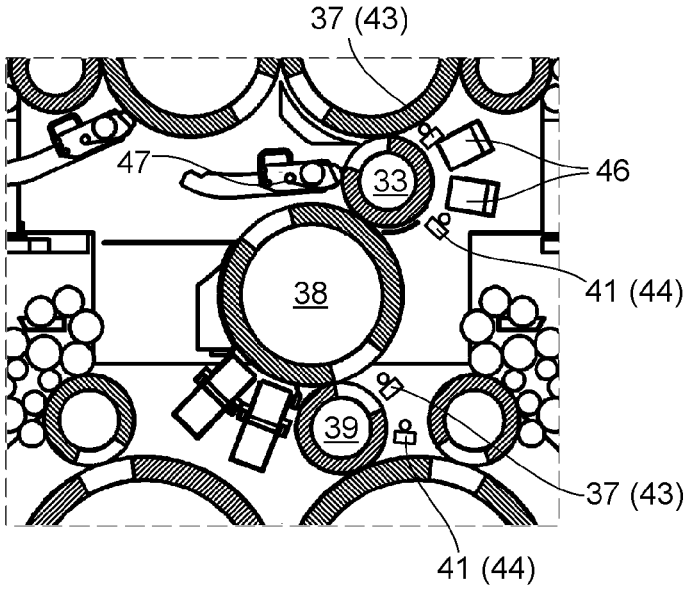
FIG. 6 shows a detail from the printing assembly according to FIG. 4, comprising the connecting passage between the printing nips, with devices for electrostatically charging the substrate.
Figure 7:
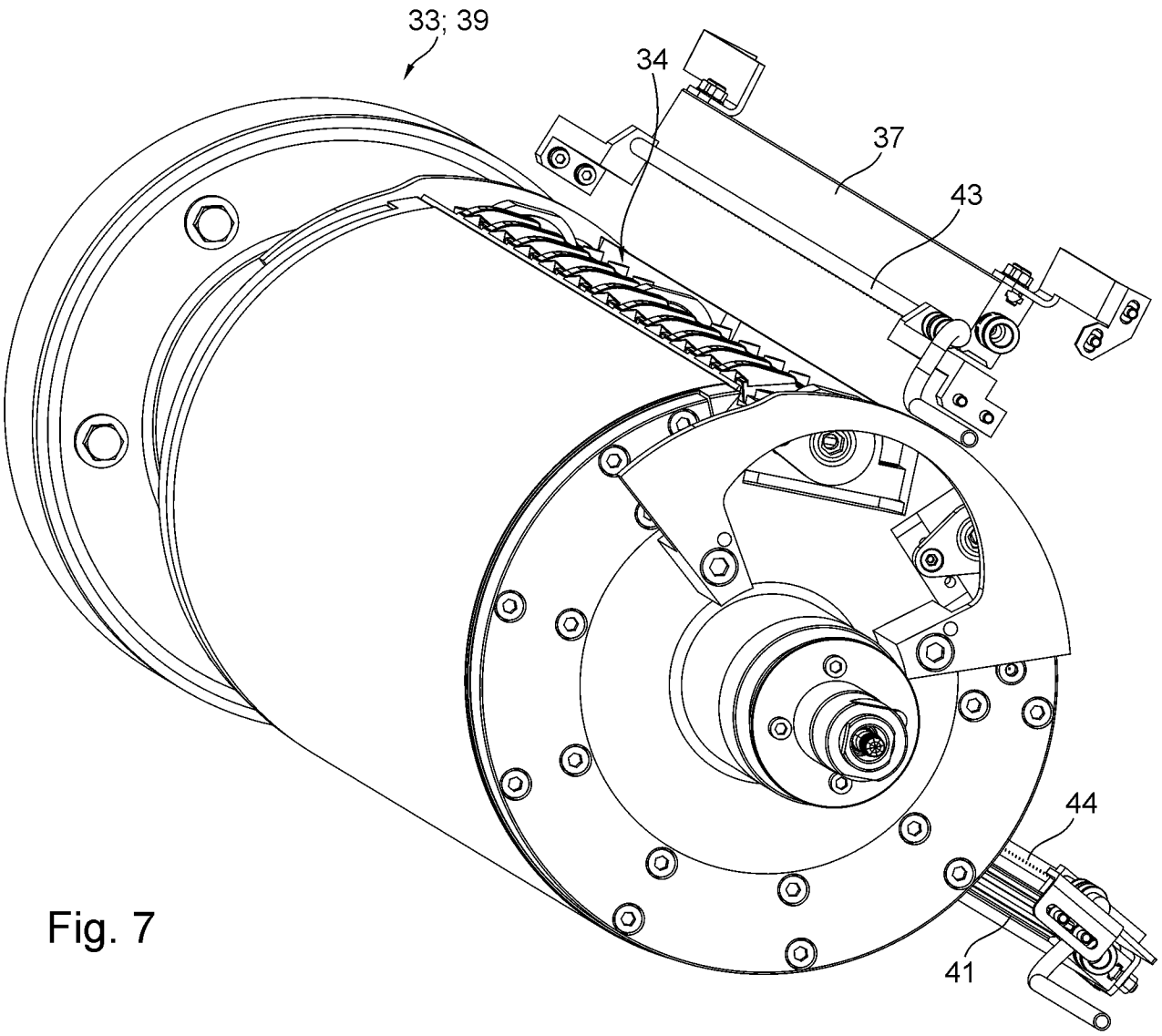
FIG. 7 shows a rotating transport means with electrodes and blower devices, obliquely from the left.
Figure 8:
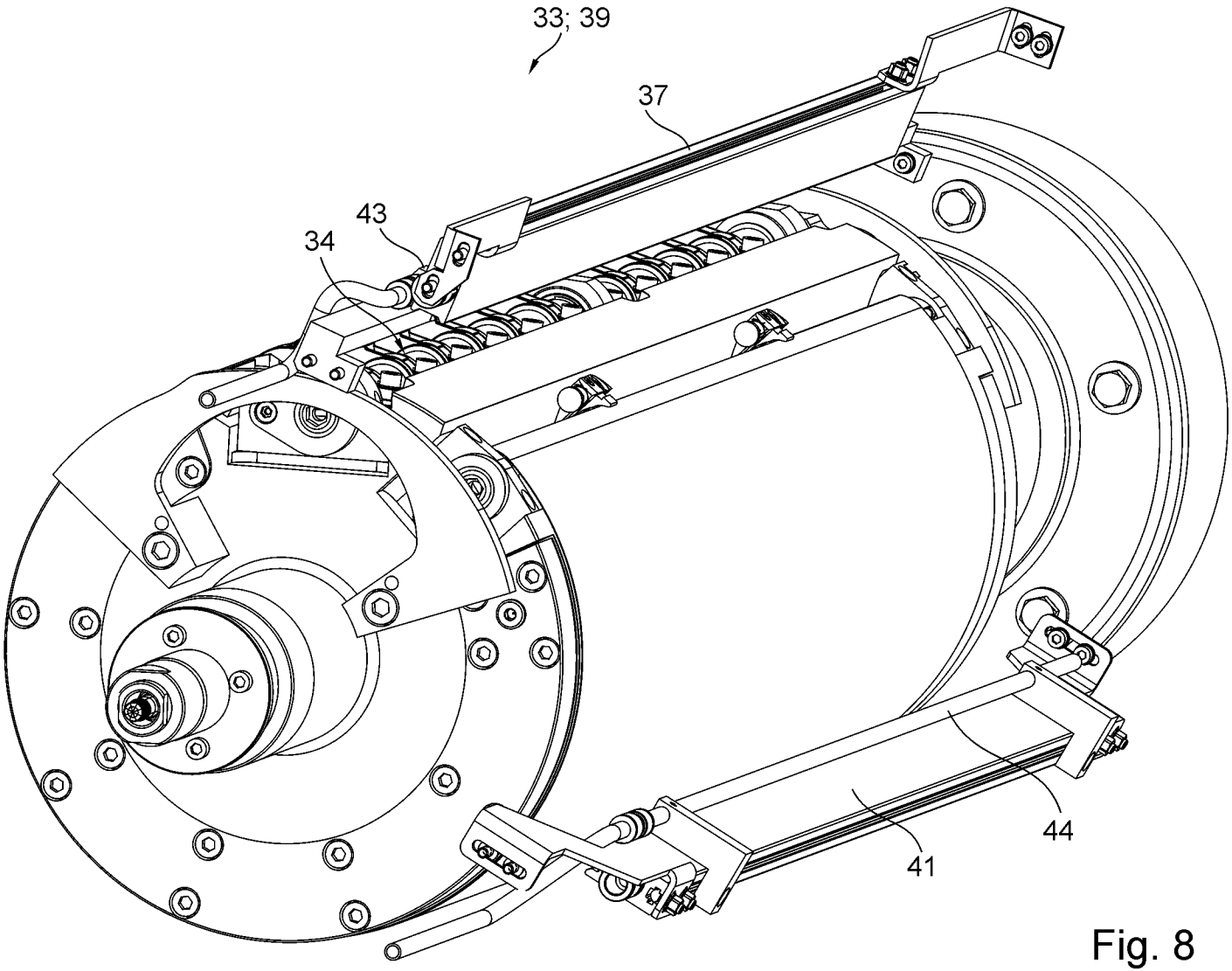
FIG. 8 shows a rotating transport means with electrodes and blower devices, obliquely from the right.
Figure 9:
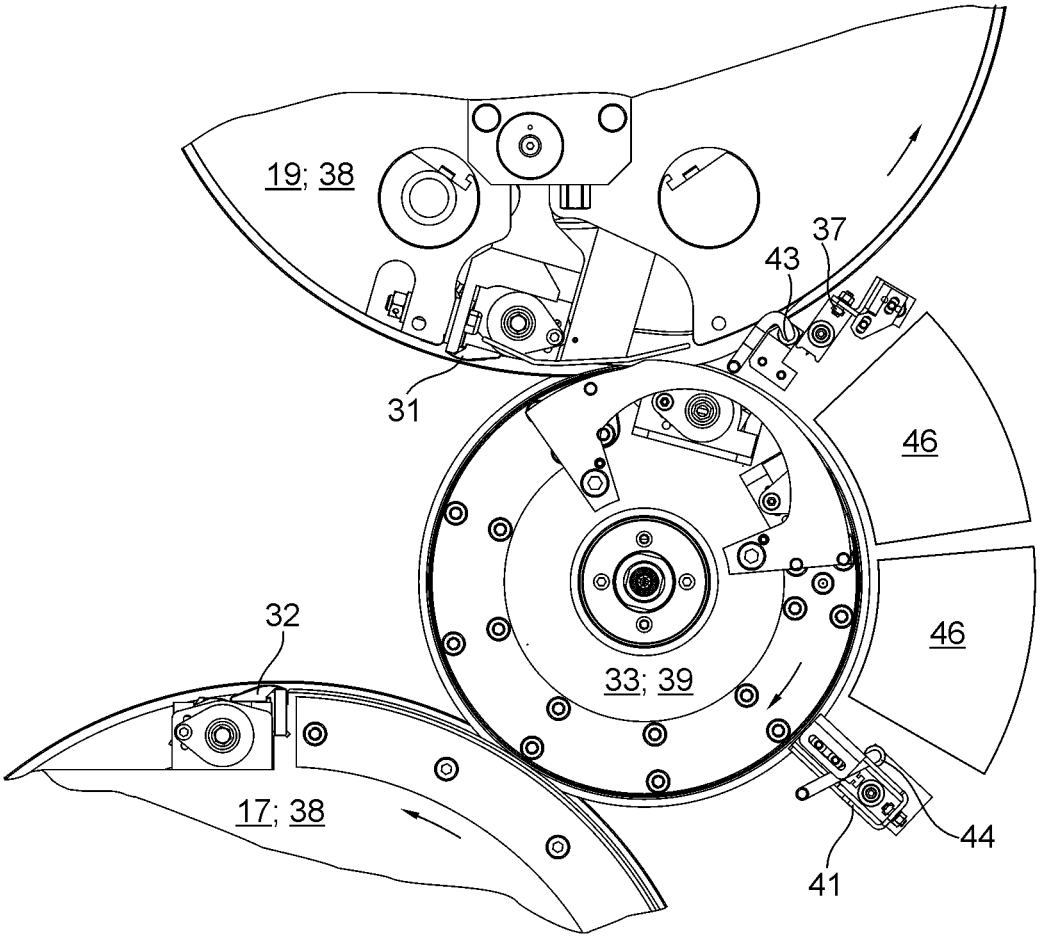
FIG. 9 shows an end-face view of a rotating transport means with electrodes and blower devices, with a transfer point from the preceding cylinder and a delivery point to the subsequent cylinder or transport means.
Figure 10:
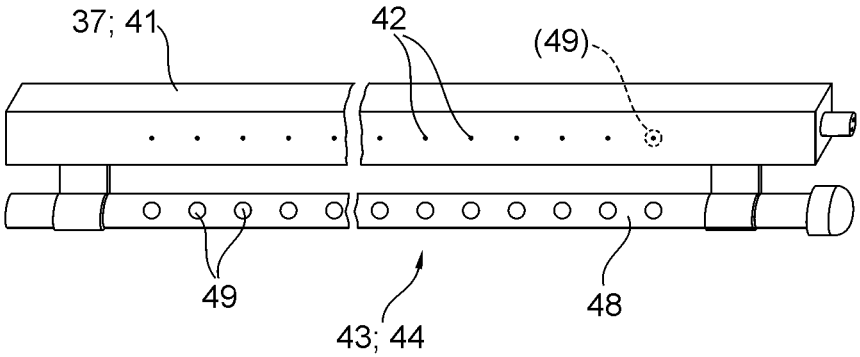
FIG. 10 shows a view of the side of an electrode that faces the transport means, with a blower device.

A printing press, in particular a printing press that prints on sheet-format printing substrate 02, comprises on the input side a feed device 01, e.g. a sheet feeder 01 or optionally a roll unwinder with a cross-cutting device downstream, which supplies the printing press with printing substrate 02 on the input side, a printing nip group 03; 03*  comprising multiple printing units 06; 07; 08; 09, by means of which the sheet-format printing substrate 02, or printing substrate sheet 02 for short, is or can be printed one or more times in one or more colors on one or both sides, and a product delivery 04, e.g. pile delivery 04, where the printed printing substrate sheets 02 are delivered as products or intermediate products in the form of a pile or continuously (see, e.g., FIG. 1 or FIG. 4). In the embodiment preferred here and depicted in the figures, the printing press is embodied as a security printing press, e.g. is configured to produce, from already printed or unprinted printing substrate sheets 02, or sheets 02 for short, sheets of securities 02, in particular, e.g. sheets having a plurality of banknotes per sheet 02, as products or as intermediate products for further processing.

In the printing substrate path, the printing couples 06; 07; 08; 09 of the printing nip group 03; 03*  can be arranged individually or in groups in multiple separate assemblies 03.1; 03.2; 03.1*; 03.2* on the transport path, or can all be arranged in one common assembly. Generally, two printing couples 06; 07; 08; 09 that work together in a printing nip 11 acting as a blanket-to-blanket printing nip 11, two printing couples 06; 07; 08; 09 that print the printing substrate 02 on the same side or on opposite sides of the printing substrate in single-sided printing nips 11; 12 that are spaced apart from one another in the transport path, one printing couple 08 arranged on one side and, upstream or preferably downstream, two printing couples 06; 07 that form a blanket-to-blanket printing couple 06, 07 or a blanket-to-blanket printing nip 11, or four printing couples 06; 07; 08; 09 in pairs, each forming a blanket-to-blanket printing couple 06, 07; 08, 09 or a blanket-to-blanket printing nip 11; 12 may be provided. Preferably, at least two printing nips 11; 12 are provided one behind the other in the transport path, at least one of these, preferably at least the downstream one, being embodied as a blanket-to-blanket printing nip 11, or even both printing nips 11; 12 being embodied as blanket-to-blanket printing nips 11; 12. In the embodiment shown here, the printing couples 06; 07; 08; 09 of the printing nip group 03; 03* are provided here in a printing nip group 03; 03* that forms a printing tower 03; 03*, for example in two stacked assemblies 03.1; 03.2; 03.1*; 03.2*, e.g. printing units 03.1; 03.2; 03.1*; 03.2*. The transport path between the printing nips 11; 12 runs from top to bottom here. This is understood not only as movement that is directed perpetually downward along the entire transport path, but rather as movement that results in a transport movement leading from top to bottom.

The printing couples 06; 07; 08; 09 that form the two printing nips 11; 12 are advantageously arranged here one above the other in the same frame associated with the printing nip group 03; 03*, or in two sub-frames arranged one above the other, each assigned to one printing unit 03.1; 03.2; 03.1*; 03.2*.

The printing couples 06; 07; 08; 09 of the spaced apart printing nips 11; 12 can generally be configured based on different printing methods. At least the printing couple or printing couples 06; 07 that is or are involved in the second or downstream printing nip 11 in the transport path is or are preferably embodied based on an indirect printing method. Preferably, the at least one printing couple 08; 09 of the upstream printing nip 12 or each of the two printing couples 08, 09 cooperating as a blanket-to-blanket printing nip 12 are likewise embodied as based on an indirect printing method.

The printing substrate sheets 02 are preferably carried through and between the two printing nips 11; 12 by a transport system with successive sheet transfers between rotating transport means 33; 38; 39, e.g. transport cylinders 33; 38; 39 and/or transport drums 33; 38; 39, that are involved in the transport. On the output side of the last printing nip 11 to a subsequent assembly or to the product delivery 04, this can likewise be carried out via a system that involves the transfer of sheets between cylinders and/or drums, but is effected here by a transport system 13 with a circulating tractive means, e.g. a chain gripper system 13. Downstream of the last printing nip 11, at least one drying device 14, in particular a radiation dryer 14, e.g. an IR or UV dryer, can be provided in the transport path, preferably on both sides thereof.

A printing couple 06; 07; 08; 09 configured for indirect printing comprises a cylinder 16; 17; 18; 19, e.g. printing couple cylinder 16; 17; 18; 19, configured as a transfer cylinder 16; 17; 18; 19, which forms a printing nip 11; 12 with a cylinder 17; 16; 18; 19; 19*, e.g. printing couple cylinder 17; 16; 18; 19; 19*, acting as an impression cylinder. In the case of a blanket-to-blanket printing nip 11; 12, the printing couple cylinder that acts as an impression cylinder is likewise formed by an ink-carrying printing couple cylinder 17; 16; 18; 19, in particular by the transfer cylinder 17; 16; 18; 19 of the printing couple 06; 07; 08; 09 that forms a blanket-to-blanket printing couple 06; 07; 08; 09 with the first-mentioned printing couple 06; 07; 08; 09. The transfer cylinder 17; 16; 18, 19 cooperates, upstream with respect to the flow of ink, with at least one image-producing cylinder 21; 22; 23; 24, e.g. printing couple cylinder 21; 22; 23; 24, e.g. at least one forme cylinder 21; 22; 23; 24, which is or can be inked with printing ink upstream by a suitable inking device 26; 27; 28; 29, e.g. an inking unit 26; 27; 28; 29.

Although the forme cylinder 21; 22; 23; 24 and the associated inking unit 26; 27; 28; 29 can generally be embodied as based on any printing method, they are preferably embodied as based on a planographic printing method, in particular an indirect planographic method, or on a letterpress or relief printing method, in particular indirect, in particular a letterset printing method. For this purpose, in the first-mentioned embodiment the forme cylinder 21; 22; 23; 24 carries a planographic printing forme (not shown here) on its outer circumference, e.g. an offset printing forme for wet or dry offset, which cooperates with an inking unit suitable for planographic printing, in the case of wet offset, e.g. a roller inking unit 26; 27; 28; 29 having an ink fountain upstream and having a dampening unit, and in the case of dry offset, e.g. having a short inking unit 26; 27; 28; 29 comprising a saucer roller and a doctor blade device, for example. For the embodiment for planographic printing, the forme cylinder 21; 22; 23; 24 carries a letterpress printing forme (not shown here) on its outer circumference, which cooperates with an inking unit 26; 27; 28; 29 suitable for letterpress printing, e.g. a roller inking unit 26; 27; 28; 29 having an ink fountain upstream.

In a particularly preferred embodiment, on at least one side of the transport path at least one of the printing couples 06; 07; 08; 09, the first and/or the second in the transport path, is embodied as a collect printing couple 06; 07; 08; 09, i.e. for the simultaneous, in particular multicolor, printing of two print image segments. The printing couple 06; 07; 08; 09 configured as a collect printing couple 06; 07; 08; 09 comprises as a transfer cylinder 16; 17; 18; 19 an ink-carrying printing couple cylinder 16; 17; 18; 19 that acts as a collect cylinder 16; 17; 18; 19, which cooperates, upstream with respect to the flow of ink, with at least two image-producing printing couple cylinders 21; 22; 23; 24, e.g. at least two forme cylinders 21; 22; 23; 24, which are inked by respective inking devices 26; 27; 28; 29, e.g. inking units 26; 27; 28; 29. Said forme cylinders 21; 22; 23; 24 and associated inking units 26; 27; 28; 29 of a collect printing couple 06; 07; 08; 09 can all be embodied, as described above, as functioning according to the planographic printing method or as functioning according to the letterpress printing method, or as functioning partly according to the planographic printing method and partly according to the letterpress printing method. If an opposing printing couple 07; 06; 09; 08 is provided, said printing couple can also be configured as a collect printing couple 07; 06; 09; 08, as described, and can have a transfer cylinder 17; 16; 19; 18 acting in the manner described above as a collect cylinder 17; 16; 19; 18.

Figure 3:
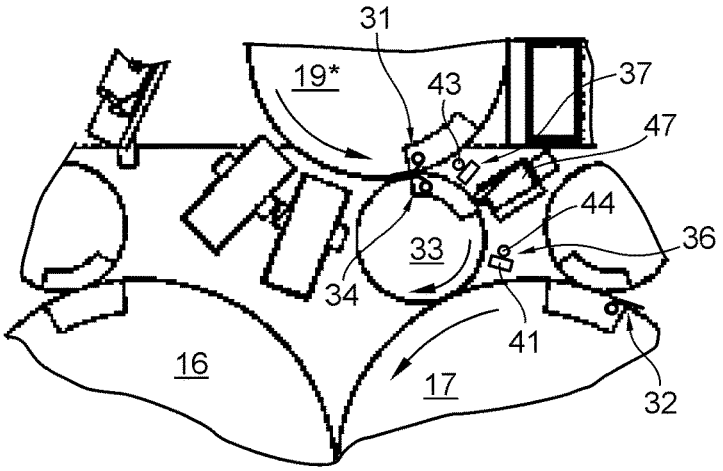
FIG. 3 shows a detail from the printing assembly according to FIG. 3, comprising the connecting passage between the printing nips, with devices for electrostatically charging the substrate.

In each printing nip 11; 12, one of the two printing couple cylinders 16; 17; 18; 19; 19* that form the printing nip 11; 12 is embodied as a transport cylinder 16; 17; 18; 19; 19* and acts as such, and preferably comprises on its outer circumference one or more holding devices 31; 32, in particular known as gripper bars 31; 32, merely indicated in FIG. 3.

As has already been set out above, sheets are transported from the one printing nip 12; 11, in particular from the printing couple cylinder 19; 19* thereof that acts as a transport cylinder 19; 19*, to the printing nip 11; 12 further downstream, in particular to the printing couple cylinder 17 thereof that acts as a transport cylinder 17, via at least one rotating transport means 33; 38; 39, e.g. a transport cylinder 33; 38; 39 or what is known as a transport drum 33; 38; 39, which preferably comprises on its outer circumference at least one holding device 34, in particular known as a gripper bar 34, which is merely indicated in FIG. 3. Thus, the transport between the two printing nips 12; 11 is preferably based on a transport system 36 involving successive sheet transfers between cylinders 19; 19*; 17 and/or transport means 33; 38; 39 that are involved in the transport. In the embodiment of the printing nip group 03; 03* having a transport path between the printing nips 12; 11 that runs from top to bottom, sheet transfer occurs in each case, e.g., starting from one of the cylinders 19; 19*; 17 or transport means 33; 38; 39 the axis of which lies at a higher point.

Therefore, in this case the cylinders 18; 19; 19* that form the first printing nip 12 and the cylinders 16; 17 that form the second printing nip 11 are advantageously arranged one above the other in the same frame or in two sub-frames arranged one above the other. The transport means 33; 38; 39 lying therebetween is or are likewise provided, for example, in the common frame, in one of the aforementioned sub-frames, in an intermediate frame provided specifically for this purpose, or, if multiple transport means 33; 38; 39 are provided, optionally divided between the aforementioned sub-frames and/or the intermediate frame.

As has already been mentioned, the transport path running from top to bottom is understood not merely as a movement that is directed perpetually downward along the entire transport path, but also, e.g., as transport paths that comprise one or more transport path sections, created, for example, by rotating transport means 33; 38; 39 arranged offset laterally from one another, and having a transport direction that runs sideways or even upwards.

On the transport path between the printing nips 12; 11, an electrode 37; 41, in particular a high-voltage electrode 37; 41, is then positioned in such a way that, when an electric voltage is applied, a sheet of printing substrate 02 that is guided past the voltage electrode is or can be electrostatically charged. As a result, said sheet is drawn by electrostatic forces toward the outer circumference of the rotating transport means 33; 39, in particular transport drum 33; 39, thereby counteracting a premature release, caused by gravitational and/or centrifugal force, of a trailing sheet section of the sheet of printing substrate 02, which is held at its leading end. This is of particular importance, e.g., for a steeply sloping transport path section, i.e. a transport path section in which the sheet of printing substrate 02 is fed from above to a transport means 33; 38; 39 or cylinder 17 that subsequently receives the sheet of printing substrate 02, and/or in the case of high centrifugal forces resulting from high production speeds and/or a small radius of the transport means 33; 39 conveying the sheet 02. In contrast to the printing couple cylinders 16; 17; 18; 19; 19* that form the first and/or second printing nip 12; 11 in the transport path, which are embodied, for example, as multiple-sized, i.e. for accommodating multiple, e.g. two or three sheets of printing substrate 02 on their outer circumference, the transport means 33 that follows the upstream printing nip 12 and/or the transport means 39 that precedes the downstream printing nip 11 is embodied as single-sized, i.e. for accommodating one sheet of printing substrate 02 on its outer circumference. An optional transport means 38 that lies therebetween can likewise be embodied as multiple-sized, e.g. double-sized.

In a preferred embodiment, the electrode 37; 41 is positioned spaced apart from the outer circumference of the associated transport means 33; 39 in the transport path in such a way that no physical contact occurs between printing substrate sheets 02 being transported on the transport means 33; 39 and the electrode 37. To this end, a distance of at least 40 mm, in particular at least 50 mm, from the circumferential surface carrying the sheet of printing substrate 02 is provided. The electrode 37; 41 is preferably positioned on the frame of the printing press that supports the transport means 33; 39 in such a way that the distance between electrode 37; 41 and transport means 33; 39 is adjustable at least in the radial direction. The circumferential or lateral surface of the transport means 33; 39 that cooperates with an electrode 37; 41 and serves to support the printing substrate sheet 02 is electrically conductive at least in regions, e.g. is formed by metal segments or preferably as sheet metal that is continuous over at least the length of the printing substrate.

For counteracting a release induced by centrifugal force, for example, it is particularly advantageous for the electrode 37 to lie no more than 60°, in particular less than 45°, preferably no more than 30°, downstream of the point at which the sheet is received from the preceding cylinder 19; 19* or transport means 38, as viewed in the production direction of rotation. For counteracting a premature release induced by gravitational force, for example, it is particularly advantageous for the electrode 41 to lie no more than 90°, in particular less than 60°, preferably no more than 45°, upstream of the point at which the sheet is delivered to the subsequent cylinder 17 or subsequent transport means 38, as viewed in the production direction of rotation. In an advantageous refinement, one rotating transport means 33; 39 is assigned two electrodes 37; 41, specifically one in an aforementioned angular region downstream of the sheet transfer and one in an aforementioned angular region upstream of the sheet delivery or sheet transfer. For the sake of clarity, the point at which the sheet is picked up or received is considered here to be the point at which the circumferential line of the transport means 33; 39 is intersected by the plane that connects the axes of rotation of the transport means 33; 39 and of the preceding cylinder 19; 19* or transport means 38. Similarly, the point at which the sheet is delivered or transferred is considered to be the point at which the circumferential line of the relevant transport means 33; 39 is intersected by the plane that connects the axes of rotation of the transport means 33; 39 and of the subsequent cylinder 17 or transport means 38.

The electrode 37; 41, as viewed in the axial direction of the associated rotating transport means 33; 39, preferably has a plurality of spaced apart electrode tips 42, e.g. at least 20, which are preferably spaced apart from one another in pairs by a distance that is shorter than the distance to the outer circumference of the transport means. These generate high field line densities at their tips. For example, a linear tip number density of 80 to 120 tips per meter is provided. The voltage applied during operation or to be provided for operation is at least 20 kV, for example, preferably even more than 25 kV. For this purpose, the electrode 37; 41 is connected to a generator that supplies the corresponding voltage.

In a particularly advantageous refinement, a blower device 43; 44 directed toward the outer circumference of the transport means is positioned upstream of the electrode 37, as viewed in the circumferential direction of the rotating transport means 33; 39. Said blower device is preferably located no more than 25°, in particular no more than 15°, upstream of the electrode 37; 41, as viewed in the circumferential direction of the transport means 33; 39, and thus supports the positioning of the printing material sheet 02 against the transport means 33; 39 and/or counteracts any unintended physical contact between printing substrate sheet 02 and electrode 37; 41. As an alternative to a specifically dedicated blower bar 48 having a plurality of blower openings 49, the blower device 43; 44 can be integrated into the housing of the electrode 37; 41, in that, for example, the side facing the transport means 33; 39 comprises both the electrode tips 42 and blower air openings 49. The latter can surround the electrode tips 42 in the form of a ring, for example.

In a refinement, one or more drying devices 46, e.g. radiation dryers 46 such as IR or UV dryers, for example, can be directed toward the circumferential section of the rotating transport means 33; 39 lying in the transport path. If there are two electrodes 37; 41, the at least one drying device 46 is arranged in the angular region therebetween, for example.

Also advantageous is a refinement in which a cleaning device 47 that cooperates with the lateral surface or circumferential surface of the transport means 33; 39 is provided. For an embodiment comprising an upstream blanket-to-blanket printing nip 12, said cleaning device can preferably be provided in an angular region of the transport means 33; 39 that does not lie in the transport path.

In the following, configurations and variants of preferred printing nip groups 03; 03* embodied in the manner of a printing tower 03; 03*, with the respective arrangement of one or more of the aforementioned electrodes 37; 41 and, in a further refinement, coordinating blower devices 43; 44 will be described in reference to FIG. 1 to FIG. 6.

In an embodiment of the printing nip group 03; 03* in which two printing nips 11; 12 are provided in the transport path, with at least the one, preferably downstream printing nip 11; 12 being configured as a blanket-to-blanket printing nip 11 for simultaneous perfecting printing and/or as having at least one printing couple 06; 07; 08; 09 embodied as a collect printing couple 06; 07 for simultaneous multicolor printing, at least one aforementioned transport means 33; 39 having at least one associated electrode 37; 41 is provided in the transport path between the two printing nips 11; 12. Preferably, at least one of the aforementioned electrodes 37; 41, for example at least the one closer to where the sheet is received, or preferably both of the aforementioned electrodes 37; 41, is assigned to the sole transport means or at least to the transport means 33 that follows the cylinder 19; 19* that acts as the transport cylinder 19; 19* of the upstream printing nip 12.

In the illustrated and preferred embodiments, at least one of the printing nips 11; 12, in particular the downstream printing nip 11, comprises two cooperating collect printing couples 06; 07, each having multiple, e.g. four, forme cylinders 21; 22 and associated inking units 26; 27 (e.g. FIG. 1, FIG. 2, FIG. 4 and FIG. 5).

In this case, the printing couple cylinders 16; 17; 18; 19; 19* that form the downstream printing nip 11 are preferably triple-sized, i.e. are embodied to accommodate three sheets of printing substrate 02 on their outer circumference.

In an embodiment variant in which one of the two printing nips 12, in particular the upstream one, is embodied only for straight printing and one of the cylinders 19* that form the printing nip 12 is configured only as an impression cylinder 19* (see, e.g., FIG. 1 and FIG. 2), only one rotating transport means 33, for example, in particular transport drum 33, is provided between the transport cylinder 19* of the upstream printing nip 12 and the printing couple cylinder 17 that acts as a transport cylinder 17 of the downstream printing nip 11. Preferably, one electrode 37; 41 is assigned to said transport means in the aforementioned manner on the receiving side and one on the delivery side. An aforementioned blower device 43; 44 is advantageously associated with each or with each respective electrode 37; 41. The blower device 44 for the second electrode 41 can optionally be dispensed with. For this embodiment as well, multiple rotating transport means 33; 38; 39 can generally also be provided between the two printing nips 12; 11 in the manner set out below.

In an embodiment variant in which the other of the printing nips 12; 11, in particular the upstream printing nip 12, likewise comprises two cooperating collect printing couples 08; 09, each having multiple, e.g. two, forme cylinders 23; 24 and associated inking units 28; 29 (e.g. FIG. 4 and FIG. 5), although generally only one rotating transport means 33 may be provided between the printing nips 12; 11, preferably multiple, e.g. three such transport means 33; 38; 39 are provided, via which the printing substrate sheet 02 to be transported is passed on in succession. In that case, at least one electrode 37; 41 and optionally an associated blower device 43; 44 is assigned in the manner specified above to at least the first rotating transport means 33; 39 that follows the upstream printing nip 12 and/or that immediately precedes the downstream printing nip 11. At least one electrode 37 that lies closer to the receiving point in the aforementioned manner is provided to the first transport means 33 downstream, and one electrode that lies closer to the delivery point in the aforementioned manner is provided to the last transport means 39.

In both variants, the printing couple cylinders 16; 17; 18; 19; 19* that form the upstream printing nip 12 are preferably embodied as double-sized, i.e. for accommodating two printing substrate sheets 02 on their outer circumference.

While preferred embodiments of a device, a method, and a printing press for multiple printing of printing substrate sheets, in accordance with the present invention, have been set forth fully and completely hereinabove, it will be obvious to one of skill in the art that various changes could be made thereto, without departing from the true spirit and scope of the present invention, which is accordingly to be limited only by the appended claims.

The invention claimed is:

1. A device for printing sheets of printing substrate (02), having a first printing nip (12) which is formed between a first cylinder (19; 19*) that acts as a transport cylinder (19; 19*) and a second cylinder (18), and in which the printing substrate sheets (02) can be printed on one or on both sides with one or more collected print image segments, and having a second printing nip (11) lying downstream in the printing substrate path, which second printing nip is disposed at a level lying below the first printing nip (12) and is formed between a third cylinder (17) that acts as a transport cylinder (17) and a fourth cylinder (16), and in which the printing substrate sheets (02) can be printed on both sides with one or more collected print image segments, wherein the printing substrate sheets (02) can be conveyed via at least one rotating transport device (33; 38; 39) along a transport path from the cylinder (19; 19*) that acts as a transport cylinder (19; 19*) of the first printing nip (12) to the cylinder (17) that acts as a transport cylinder (17) of the second printing nip (11), characterized in that on the transport path, downstream of the cylinder (19; 19*) that acts as a transport cylinder (19; 19*) of the first printing nip (12) and upstream of the cylinder (17) that acts as a transport cylinder (17) of the second printing nip (11), at least one first electrode (37; 41) directed toward an outer circumference of the at least one rotating transport device (33) is arranged in an angular segment lying in the transport path for the printing substrate sheets (02) in such a way that when an electric voltage is applied by the at least one first electrode, a printing substrate sheet (02) being guided past the at least one first electrode (37; 41) can be electrostatically charged.

2. The device according to claim 1, characterized in that a first electrode of the at least first electrode (37) is arranged directed toward the outer circumference of a downstream one of the at least one rotating transport device (33), and which first electrode is positioned immediately downstream of the transport cylinder (19; 19*) of the first printing nip (12).

3. The device according to claim 2, in that an upstream one of the at least one electrode (41) is provided directed toward the outer circumference of an upstream one of the at least one rotating transport device (39), and which is positioned immediately upstream of the transport cylinder (17) of the second printing nip (12) in the transport path.

4. The device according to claim 1, characterized in that a first electrode of the at least first electrode (37) lies no more than 60° downstream of the point at which sheets are received by the at least one rotating transport device (33; 38; 39) from the cylinder (19; 19*) upstream thereof, as viewed in the production direction of rotation.

5. The device according to claim 1, in that a first electrode of the at least first electrode (37) is provided directed toward the outer circumference of an upstream one of the at least one rotating transport device (39), and which is positioned immediately upstream of the transport cylinder (17) of the second printing nip (12) in the transport path.

6. The device according to claim 1, characterized in that an upstream one of the at least one first electrode (41) is provided, directed toward the outer circumference of the at least one rotating transport device (33; 39), and in that the upstream electrode (41) lies no more than 90° upstream of the point of sheet delivery from the at least one rotating transport device (33; 38; 39) to the cylinder (17) downstream thereof, as viewed in the production direction of rotation.

7. The device according to claim 1, characterized in that the at least one first electrode (37; 41) is one of arranged spaced at least 40 mm from the at least one rotating transport device (33; 39) transporting the printing substrate sheets (02) and is arranged to charge the printing substrate sheets (02) electrostatically without contact.

8. The device according to claim 1, characterized in that the at least one first electrode is assigned a blower device (43; 44), which is one of integrated into said at least one first electrode and is arranged upstream of the at least one first electrode (37; 41) in the transport path at a maximum angle of 25° in the circumferential direction of the transport means (33; 39).

9. The device according to claim 1, characterized in that one of the transport path runs from top to bottom between the first and second printing nips (12; 11) and in that the cylinders (19; 19*) and the at least one rotating transport device that bring about the transport path between the first and second printing nips (12; 11) are arranged in one of a single-part frame and a multi-part frame such that the at least one rotating transport device (33; 39) formed by a transport drum (33; 39) receives the printing substrate sheet (02) upstream from a transport cylinder (19; 19*), the axis of rotation of which transport drum one of lies above that of the at least one transport device (33; 39), and delivers the printing substrate sheet downstream to the transport cylinder (19; 19*), the axis of rotation of which transport cylinder lies below that of the at least one rotating transport device (33; 39), and in that the first printing nip (12) and the second printing nip device (11) are provided at different heights in a printing tower (03; 03*).

10. The device according to claim 1, characterized in that one of the second printing nip (11) is formed by two printing couples (06; 07) cooperating as a blanket-to-blanket printing nip (11), at least one of which is configured as a collect printing couple (06; 07) comprising multiple forme cylinders (21; 22), and in that the first printing nip (12) is formed by at least one printing couple (08; 09), which is configured as a collect printing couple (08; 09) having multiple forme cylinders (21; 22) and cooperates with one of a pure impression cylinder (19*) and with a further printing couple (09; 08), which is likewise configured as a collect printing couple (08; 09) having multiple forme cylinders (21; 22).

11. The device according to claim 1, characterized in that the cylinders (18; 19; 19*) that form the first printing nip (12) and the cylinders (16; 17) that form the second printing nip (11) are arranged one above the other in one of a frame and in two sub-frames arranged one above the other.

12. A printing press, for the printing of printing substrate sheets (02), comprising a device according to claim 1, characterized by one of a sheet feeder (01) located upstream of the printing nips (11; 12) in the printing substrate path and a pile delivery (04) provided downstream, and by the arrangement of the printing nips (11; 12) in a printing nip group (03; 03*) configured as a printing tower (03; 03*).

13. A method for printing sheets of printing substrate (02) in at least a first printing nip (12) and in at least a second printing nip (11), which second printing nip is spaced apart from the first printing nip (12) in a transport path of the printing substrate sheets (02) and lies at a level below the first printing nip (12), wherein the printing substrate sheets (02) are printed on one side or on both sides with one or more collected print image segments in the first of the at least two printing nips (12) in the transport path, are transported along the transport path running from top to bottom to the second of the at least two printing nips (11), where the printing substrate sheets are printed on both sides with one or more collected print image segments, wherein the transport from the first printing nip to the second printing nip (12, 11) is carried out by the successive transfer via one or more of at least one rotating transport device (33; 38; 39), characterized in that the printing substrate sheets (02) are electrostatically charged on the transport path between the first and the second printing nip (12; 11) by an electrode (37; 41) arranged on the transport path, and in that, after one of running up onto a first transport means (33) that follows the first printing nip (12), and after running up onto a last one of multiple ones of the at least one rotating transport device (39) arranged in the transport path, the printing substrate sheets (02) are charged electrostatically by the electrode (37; 41).

14. The method according to claim 13, characterized in that the printing substrate sheets (02) are charged electrostatically by the electrode (37; 41) at two points in succession on the transport path during transport by a same one of the at least one rotating transport device (33; 39).

15. The method according to claim 13, characterized in that one of the transport from the first to the second printing nip (12; 11) takes place from a higher to a lower level, and in that the at least one rotating transport device (33; 39) is formed by a transport drum (33; 39) and receives the printing substrate sheet (02) upstream from a printing couple cylinder (19; 19*), the axis of rotation of which printing couple cylinder lies above an axis of the at least one rotating transport device (33; 39), and delivers the printing substrate sheet to the printing couple cylinder (19; 19*), the axis of rotation of which printing couple cylinder lies below that of the at least one rotating transport device (33; 39).

* * * * *